US008523613B2

(12) United States Patent
Pan

(10) Patent No.: US 8,523,613 B2
(45) Date of Patent: Sep. 3, 2013

(54) ELECTRICAL CONNECTOR FOR BROADSIDE COUPLED OR EDGE COUPLED MATING WITH MATING CONNECTOR

(75) Inventor: Feng Pan, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 202 days.

(21) Appl. No.: 13/159,456

(22) Filed: Jun. 14, 2011

(65) Prior Publication Data

US 2011/0306246 A1 Dec. 15, 2011

(51) Int. Cl.
*H01R 24/00* (2011.01)

(52) U.S. Cl.
USPC ..... 439/626; 439/78; 439/607.07

(58) Field of Classification Search
USPC ..... 439/626, 82, 171, 607.05, 607.07, 439/607.09, 607.13, 751, 78, 733.1, 571, 439/572, 444
See application file for complete search history.

(56) References Cited

U.S. PATENT DOCUMENTS

| | | | | |
|---|---|---|---|---|
| 7,322,856 | B2 * | 1/2008 | Laurx et al. | 439/607.1 |
| 7,331,802 | B2 | 2/2008 | Rothermel et al. | |
| 7,390,219 | B2 | 6/2008 | Pan | |
| 7,488,219 | B2 * | 2/2009 | Matsumura | 439/751 |
| 7,553,190 | B2 * | 6/2009 | Laurx et al. | 439/607.07 |
| 7,604,502 | B2 * | 10/2009 | Pan | 439/607.08 |
| 2007/0270001 | A1 * | 11/2007 | Matsumura | 439/82 |
| 2012/0058655 | A1 * | 3/2012 | Chien et al. | 439/78 |
| 2012/0058680 | A1 * | 3/2012 | Pan et al. | 439/626 |
| 2012/0220170 | A1 * | 8/2012 | Pan | 439/660 |

* cited by examiner

*Primary Examiner* — Hae Moon Hyeon
(74) *Attorney, Agent, or Firm* — Ming Chieh Chang; Wei Te Chung

(57) ABSTRACT

An electrical connector (100) includes a housing (1) and a number of contacts (2) mounted on the housing. The housing includes a mounting portion (11), and a receiving room (10) on one side of the mounting portion. Each of the contacts (2) includes a body portion (21) mounted on the mounting portion, and a mating portion (22) extending form the body portion and projecting into the receiving room. The mounting portion includes a number of mounting slot (14) each including a first slot (15) and a second slot (16) crossed with the first slot. The contacts are selectively mounted on either the first slots or the second slots.

11 Claims, 6 Drawing Sheets

ELECTRICAL CONNECTOR FOR BROADSIDE COUPLED OR EDGE COUPLED MATING WITH MATING CONNECTOR

BACKGROUND OF THE INVENTION

1. Field of the Invention

The present invention relates to an electrical connector, and more particularly to an electrical connector for communication applications.

2. Description of Related Arts

In communication applications, a header connector and a receptacle connector mating with the header connector are widely used for transmitting high speed signal. Generally, the header connector comprises a plurality of header contacts each having a flat shape, and the receptacle connector comprises a plurality of receptacle contacts each having a bifurcated shape for mating with the header contact. There are two mating types between header contacts and receptacle contacts, namely broadside coupled and edge coupled.

U.S. Pat. No. 7,390,219, issued on Jun. 24, 2008, to Pan discloses a receptacle having mating contact ends of edge engagement type. According to the disclosure, the receptacle comprises a plurality of contacts disposed in a vertical plane. Each of the contacts comprises a bifurcated mating portion defining a mating slot. The bifurcated mating portion comprises a pair of contact surfaces facing to the mating slot for edge engagement or coupling with the mating contacts, and a pair of side faces perpendicular to the contact surfaces. The contact surfaces having a first width, and the side surface having a second surface larger than the first width. Therefore, this mating fashion is called edge coupled.

U.S. Pat. No. 7,331,802, issued on Feb. 19, 2008, to Rothermel et al. discloses a receptacle contact and a header contact broadside coupled with the receptacle contact. According to the disclosure, the receptacle contact comprises a mating surface to abut against with the header mating contact. Therefore, this mating fashion is called broadside coupled. The insulative housing of the header defines only one type of receiving holes such that the header only may broadside coupled with the receptacle. If the header were to be edge coupled with the receptacle, a new insulative housing having a different type or orientation of receiving holes is required. Therefore, the cost is increased.

Hence, an improved electrical connector is desired to offer advantages over the related art.

SUMMARY OF THE INVENTION

An object of the present invention is to provide an electrical connector which can be selectively provided with broadside couple or edge side couple with a mating connector.

To achieve the above-mentioned object, an electrical connector comprises a housing and a plurality of contacts mounted on the insulative housing. The insulative housing comprises a mounting portion and a receiving room on one side of the mounting portion. The mounting portion comprises a plurality of mounting slots each comprising a first slot and a second slot crossed with the first slot. Each of the contacts comprises a body portion mounted on the mounting portion, and a mating portion extending form the body portion and projecting into the receiving room. The contacts are selectively mounted on either the first slots or the second slots.

According to the present invention, the housing defines a first slot and a second slot. The contacts are selectively mounted on either the first slots to form a broadside coupling or the second slots to form a edge coupling with or according to contacts of a mating connector.

DETAILED DESCRIPTION OF THE PREFERRED EMBODIMENT

Reference will now be made in detail to a preferred embodiment of the present invention.

Figure 1:
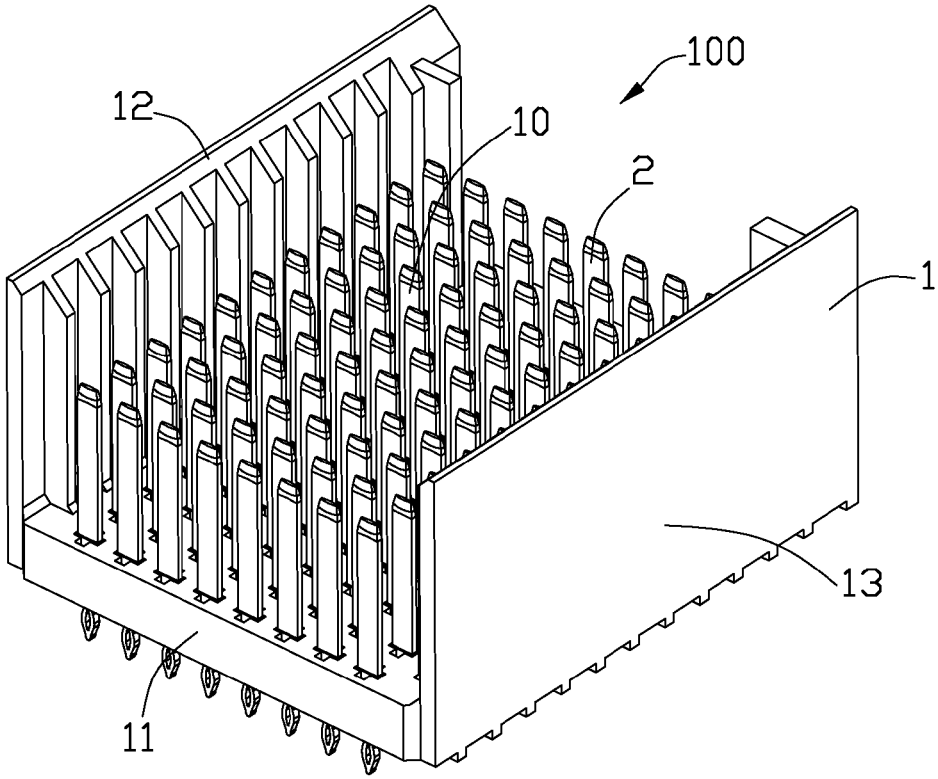
FIG. 1 is a perspective view of an electrical connector in accordance with the present invention showing the contacts mounted on the first slots.
Figure 2:
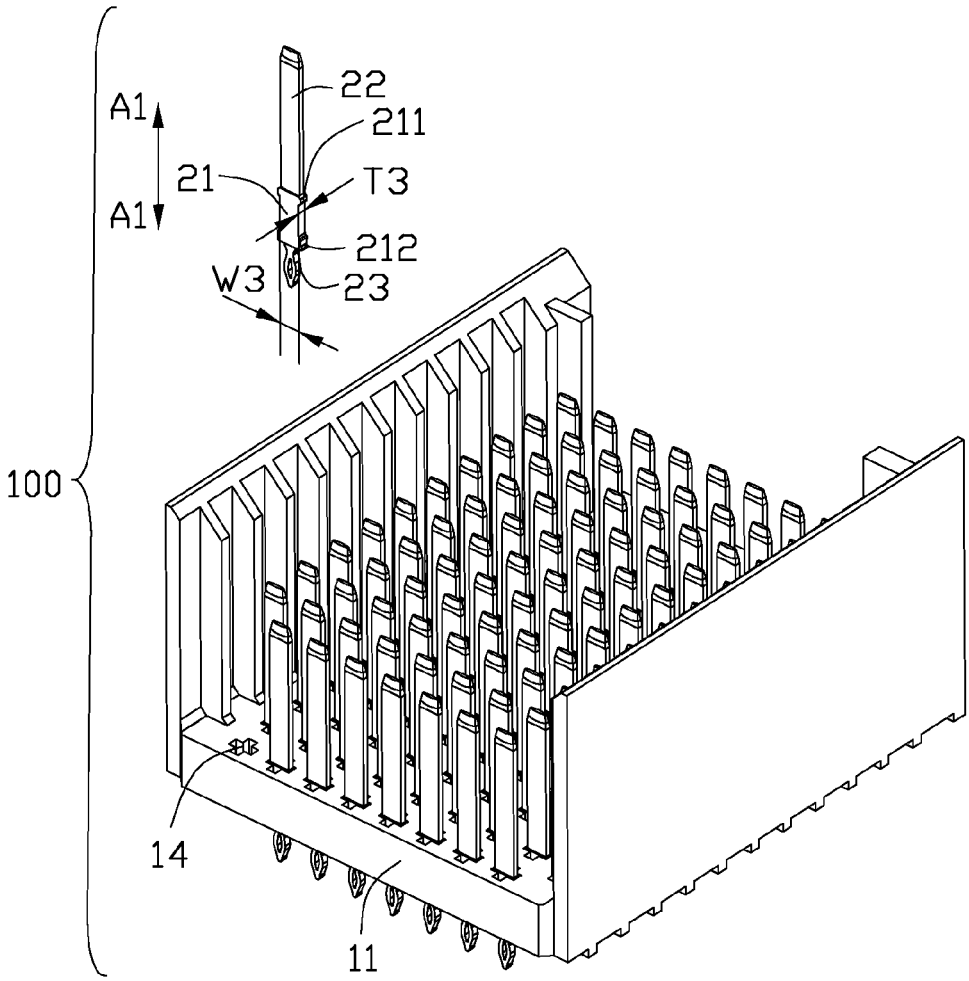
FIG. 2 is a partly exploded view of the electrical connector as shown in FIG. 1.
Figure 3:
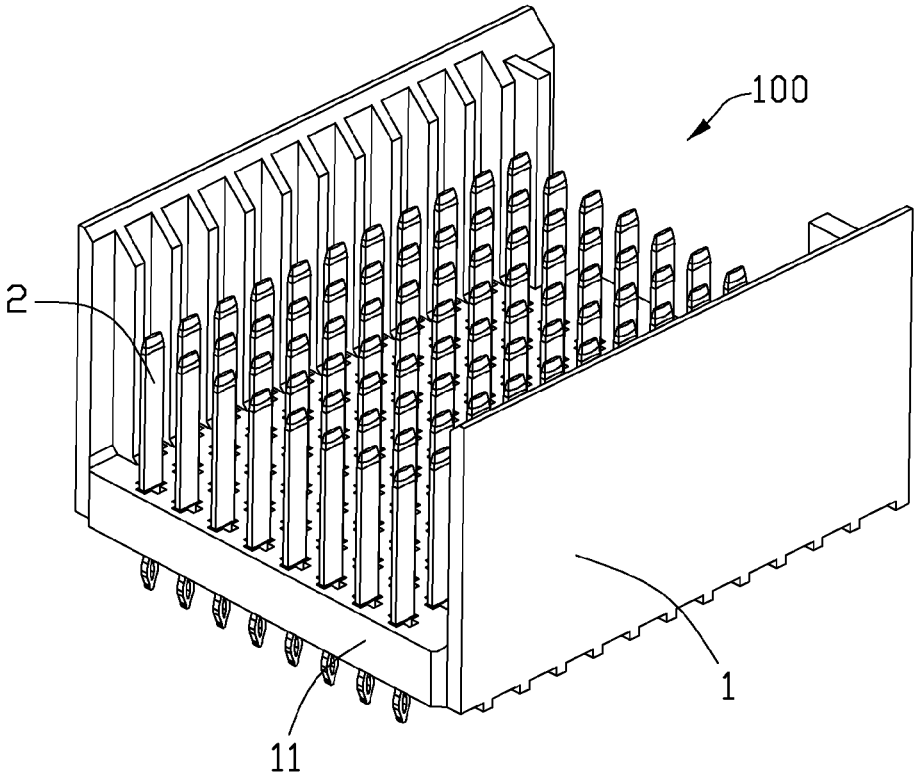
FIG. 3 is a perspective view of an electrical connector in accordance with the present invention showing the contacts mounted on the second slots.
Figure 4:
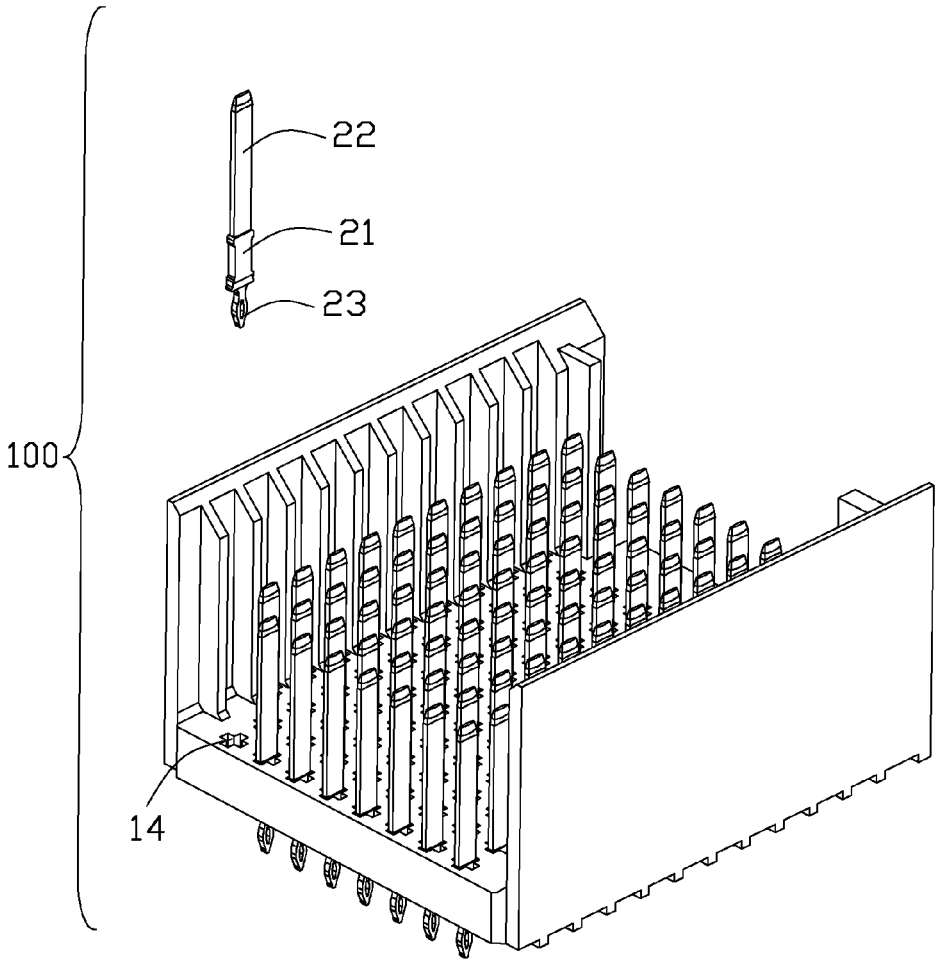
FIG. 4 is a partly exploded view of the electrical connector as shown in FIG. 3.

Referring to FIGS. 1 and 3, an electrical connector 100 comprises an insulative housing 1, a plurality of contacts 2 mounted on the insulative housing 1 and arranged in a plurality of columns and rows. Referring to FIG. 1, the contacts 2 are mounted on the insulative housing 1 and arranged in a first fashion. Referring to FIG. 3, the contacts 2 are mounted on the insulative housing 1 and arranged in a second fashion. The electrical connector 100 may mate with a mating connector and transmit signals through broadside couple when the contacts 2 are arranged in a first fashion. The electrical connector 100 may mate with the mating connector and transmit signals through edge couple when the contacts 2 are arranged in a second fashion. Referring to FIG. 2, the contacts 2 extend along a first direction A1-A1.

Figure 5:
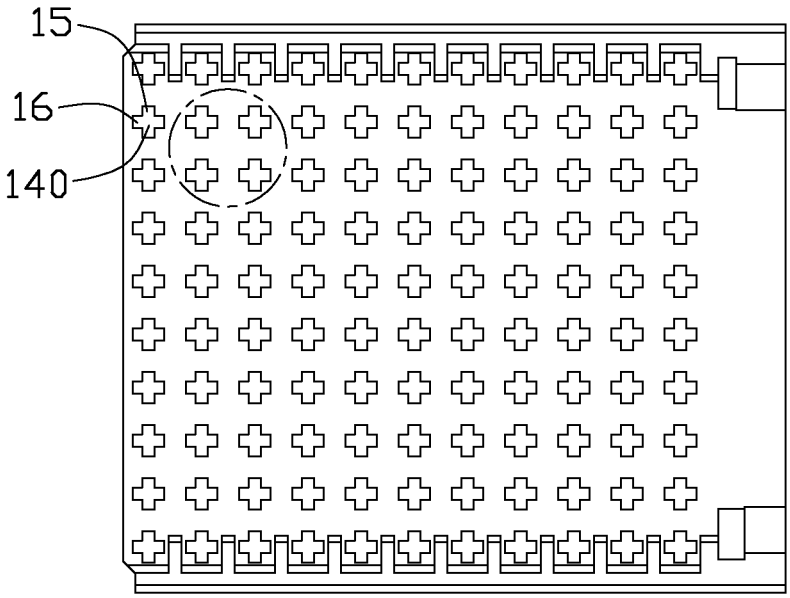
FIG. 5 is top view of the insulative housing in accordance with the present invention.
Figure 6:
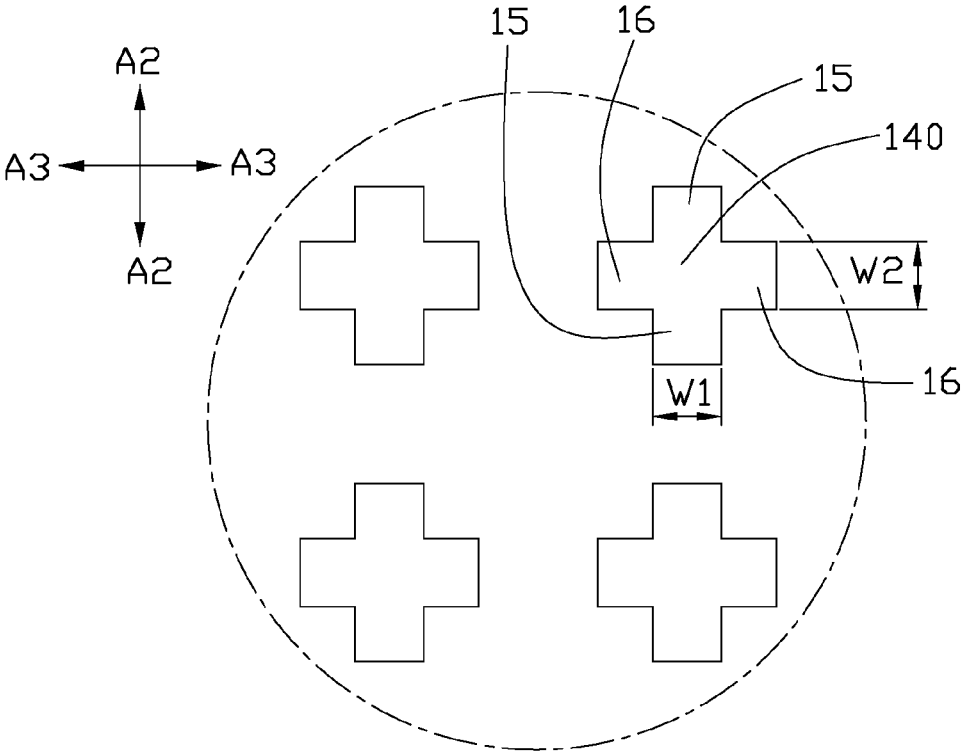
FIG. 6 is an enlarged view showing the circled portion as shown in FIG. 5.

Referring to FIGS. 1 to 4, the insulative housing 1 has a "U" shape from a side view. The insulative housing 1 comprises a mounting portion 11, a first side wall 12 extending from a first end of the mounting portion 11 upwardly, an opposite second side wall 13 extending from a second end of the mounting portion 11 upwardly, and a receiving room 10 defined between the first side wall 12 and the second side wall 13 for receiving a mating connector. Referring to FIGS. 2, 5 and 6, the mounting portion 11 defines a plurality of mounting slots 14. Each of the mounting slots 14 comprises a first slot 15 extending along a second direction A2-A2, a second slot 16 extending along a third direction A3-A3 perpendicular to the second direction A2-A2. The first direction A1-A1 is perpendicular to the second direction A2-A2 and third direction A3-A3. The first slot 15 shares a common portion 140 with the second slot 16. The first slot 15 has a first width W1, and the second slot 16 has a second width W2 equal to the first width W1.

Referring to FIGS. 1 to 4, the contacts 2 are generally of blade types and are mounted to the insulative housing 1 along the first direction A1-A1. Each of the contacts 2 comprises a body portion 21 received in the mounting portion 11, a mating portion 22 having a flat shape extending from a first end of the body portion 21 and projecting into the receiving room 10, and a tail portion 23 extending from a second end of the body portion 21 opposite to the first end and beyond the mounting portion 11. The body portion 21 has a flat shape. The body portion 21 has a width W3 and a thickness T3 smaller than the width W3. The body portion 21 comprises a first projecting tab 211 disposed adjacent to the mating portion 22 and projecting outwardly along a widthwise direction, and a second projecting tab 212 disposed adjacent to the tail portion and projecting outwardly along the widthwise direction.

Referring to FIGS. 2 and 3, the body portion 21 is selectively mounted on the first slot 15 or the second slot 16. The first projecting tab 211 and the second projecting tab 212 are selectively mounted on the first slot 15 or second slot 16 to assemble the contact 2 to the insulative housing 1. When the contacts 2 are mounted on the first slots 15, the contacts 2 are arranged in a first fashion, e.g. with reference to the locations of the two side walls 12 and 13, to broadside couple with mating contacts. When the contacts 2 are mounted on the second slot 16, the contacts 2 are arranged in a second fashion, e.g. with reference to the locations of the two side walls 12 and 13, to edge couple with the mating contacts. The electrical connector 100 could use the same insulative housing 1 and the same contacts 2 to realize broadside couple or edge couple, through the contacts 2 selectively mounted on the first slots 15 or the second slots 16. Therefore, the electrical connector 100 could be used in different applications.

It is to be understood, however, that even though numerous characteristics and advanarmes of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a housing comprising a mounting portion and a receiving room on one side of the mounting portion, the mounting portion comprising a plurality of mounting slots each comprising a first slot and a second slot crossed with the first slot; and a plurality of contacts each comprising a body portion mounted on the mounting portion, and a mating portion extending form the body portion and projecting into the receiving room, the contacts being selectively mounted on either the first slots or the second slots.

2. The electrical connector as recited in claim 1, wherein the first slot extends along a first direction, and the second slot extends along a second direction perpendicular to the first direction, the first slot sharing a common portion with the second slot.

3. The electrical connector as recited in claim 2, wherein the first slot and the second slot have a same width.

4. The electrical connector as recited in claim 1, wherein each of the body portions has a flat shape having a width and a thickness smaller than the width.

5. The electrical connector as recited in claim 4, wherein each of the mating portions has a flat shape, the body portion comprising a first projecting tab disposed adjacent to the mating portion and projecting outwardly along a width direction.

6. The electrical connector as recited in claim 5, wherein each of the contacts comprises a tail portion extending from the body portion and beyond the mounting portion of the housing, the body portion comprising a second projecting tab disposed adjacent to the tail portion and projecting outwardly along the width direction.

7. The electrical connector as recited in claim 1, wherein the housing comprises a first side wall extending from an end of the mounting portion, and a second side wall extending from an opposite end of the mounting portion, the receiving room being defined between the first side wall and the second side wall.

8. The electrical connector as recited in claim 1, wherein each of the contacts extends along a first direction perpendicular to the mounting portion.

9. The electrical connector as recited in claim 8, wherein the first slot extends along a second direction perpendicular to the first direction, and the second slot extends along a third direction perpendicular to the second direction.

10. An electrical connector comprising:

an insulative housing defining a mounting portion with a receiving room above the mounting portion;

a plurality of mounting slots extending through the mounting portion, each of said mounting slots defines a cross-like cross-section; and a plurality of contacts disposed in the corresponding mounting slots, respectively, each of said contact defining a planar body portion retained in the corresponding mounting slot, and a mating portion extending upwardly from the body portion into the receiving room; wherein the body portion is selectively orientated in the corresponding mounting slot in either first or second directions perpendicular to each other.

11. The electrical connector as claimed in claim 10, wherein each of said mounting slots comprises a first slot and a second slot crossed with each other, said first slot and said second slot having a same width and a same thickness with each other.

* * * * *